US005634513A

United States Patent [19]

Ishiguro et al.

[11] Patent Number: 5,634,513

[45] Date of Patent: Jun. 3, 1997

[54] CONTINUOUS CASTING METHOD

[75] Inventors: Susumu Ishiguro; Masaki Nitta; Kenzo Ayata; Hideo Mori, all of Kakogawa, Japan

[73] Assignee: Kabushiki Kaisha Kobe Seiko Sho, Kobe, Japan

[21] Appl. No.: 525,008

[22] Filed: Sep. 8, 1995

[30] Foreign Application Priority Data

Sep. 9, 1994 [JP] Japan ..... 6-216011
Aug. 10, 1995 [JP] Japan ..... 7-204151

[51] Int. Cl.[6] ..... B22D 11/12; B21B 1/46

[52] U.S. Cl. ..... 164/476; 164/417

[58] Field of Search ..... 164/476, 417

[56] References Cited

U.S. PATENT DOCUMENTS 4,687,047 8/1987 Ogibayashi et al. ..... 164/476

FOREIGN PATENT DOCUMENTS 3-90260 4/1991 Japan ..... 164/476

*Primary Examiner*—Kuang Y. Lin

*Attorney, Agent, or Firm*—Oblon, Spivak, McClelland, Maier & Neustadt, P.C.

[57] ABSTRACT

To provide a continuous casting method to diminish as much as possible center segregation and center porosity in the center of the cast piece, structure, a continuous casting method includes the application of reduction to a cast piece in the final solidification stage of the cast piece draw out process of continuous casting. The reduction is commenced at a point after the center solid fraction of the cast piece has reached 0.2, and the reduction gradient is decreased as the center solid fraction grows larger. The enlargement of the center solid fraction is divided into at least three zones with an optimal reduction gradient (%/m) established for each of the zones.

4 Claims, 4 Drawing Sheets

CONTINUOUS CASTING METHOD

BACKGROUND OF THE INVENTION

1. Field of the Invention

This invention relates to a means for diminishing as rapidly as possible the segregation and porosity of the center of the cast piece.

2. Description of the Related Art

One important issue in continuous casting is how to alleviate the segregation and center porosity occurring in the center of the cast piece. Good results are being obtained by use of electromagnetic stirring and low temperature casting to prevent segregation or additives to promote heterogeneous nucleation, and segregation dispersion technology is implemented by bulk forming of equiaxed crystal. Further, high level purifying processes are being introduced to reduce concentrations of impurities (phosphorus and sulfur etc.) in molten steel. Anti-bulge technology is being implemented during the cast piece drawing out process.

However it is clear that countermeasures are inadequate, for the process in which segregation is brought about by the molten metal flow accompanying solidification shrinkage during final solidification or the process in which center porosity is formed as a direct result of said solidification shrinkage.

Whereupon in recent years continuous casting technology has been proposed using several pair of reduction rollers in the final stage of the cast piece draw out process and applying reduction at a low reduction rate to cast pieces in the final solidification stage. By applying this kind of reduction, the said molten flow can be inhibited to help prevent segregation, and solidification shrinkage can be corrected, to prevent formation of center porosity, ultimately allowing manufacture of a continuous casting product having no defects.

Technology contributing towards this reduction method is known in such public literature as Japanese Laid-open No.s 59-16862, 3-6855, 3-8863, 3-8864, 4-20696, 4-22664 and 5-30548. This public literature on the position (namely the interval from starting the reduction until finish of the reduction) for reduction all indicates a common concept. However the above methods proposing for instance technology to control the reduction rate (within 1.5%) or quantity of reduction rate (0.5 mm per minute to 2.5 mm per minute) or reduction at 0.6 $\epsilon$ mm per minute to 1.1 $\epsilon$ mm per minute ($\epsilon$ is a reciprocal number of ¼th of the flatness ratio of cast pieces) still do not provide any decisive condition of reduction.

There is however specific equipment technology for performing the reduction as provided for instance in methods in Japanese Patent Laid-open No.s 50-55529 and 54-38978 for a roll (generally termed a flat roll) of the same width as the cast piece or roll barrel longer than the cast piece width, as for instance the roll as revealed in Japanese Patent Laid-open No. 2-56982 wherein the diameter of center part of roll is made slightly larger than that of the other part (referred to in this invention as a stubby roll).

The above existing reduction technology has the haphazard approach of trying to define reduction conditions such as the extent of reduction required, leaving the basic problem unsettled. Further, till now progressive changes occurring in the center solid fraction during the reduction process has not been considered and nothing has been revealed regarding how to alter the extent of the reduction in response to changes in the center solid fraction. For instance, in dealing with internal cracks prone to occur in high carbon steel or in particular with proper reduction conditions for bloom continuous casting, the studies done up until now can only called totally insufficient.

SUMMARY OF THE INVENTION

This invention in view of the above situation, proposes a method for manufacturing cast pieces that prevents V segregation, and also prevents internal cracks and inverse V segregation that worsens segregation. Namely this invention introduces a new concept of "reduction gradient" described later for a small reduction gradient in the final solidifying stage and also provides a method for changing reduction gradient in response to an increase in the center solid fraction in the final solidifying stage (increase in center solid fraction accompanying a gradual drop in temperature of the cast piece as it moves to the downstream side in continuous casting draw-out).

More specifically, in the continuous casting method of this invention, reduction is gradually applied to the cast piece during the draw-out process when the center solid fraction of the cast piece is at least within the ranges below. The reduction gradient (percentage of reduction amount for cast piece thickness for the draw-out length of the cast piece (units:meters) is applied so as to satisfy the conditions listed below.

For zone (1) in which the center solid fraction $\geqq 0.2$ and $\leqq 0.45$

The reduction gradient (%/m)=0.70–0.90 (A)

For zone (2) in which the center solid fraction $\geqq 0.35$ and $\leqq 0.75$

The reduction gradient (%/m)=0.30–0.48 (B)

For zone (3) in which the center solid fraction $\geqq 0.65$ and $\leqq 0.90$

The reduction gradient (%/m)=0.08–0.16 (C).

In the continuous casting method of this invention at least three zones are provided for handling the increased center solid fraction accompanying the growth in solidification of the cast piece, and there are three reduction gradients (A) to (B) to (C) corresponding to these zones to change gradually to smaller amounts.

The reduction gradient (%/m) for the said continuous casting method in which zone (1) and zone (2) overlap to apply a reduction so that; in a center solid fraction=0.35 to 0.45 for zones (1–2)

the reduction gradient (%/m) must be equal to 0.30 to 0.90 (A-B)

and the reduction gradient must be:

the same or smaller than that selected in zone (1) and, the same or larger than that selected in zone (2)

and/or when zones (2) and zones (3) overlap to apply a reduction so that, in a center solid fraction=0.65 to 0.75 for zones (2–3)

the reduction gradient (%/m) must be equal to 0.08 to 0.48 (B-C)

and the reduction gradient must be:

the same or smaller than that selected in zone (2) and, the same or larger than that selected in zone (3).

In this case the reduction gradient is divided into 3 to 5 zones as needed and the corresponding reduction gradient changes from large to small (A) to (A–B) to (B) to (B–C) to (C) as needed in the continuous casting process.

There are no special restrictions on the use of the reduction roll of this invention, however it is recommended that when reduction in a zone after reaching a center solid fraction of 0.35 to 0.45, a reduction roll having an roll barrel of 0.2 to 0.8 times that of the cast piece width be applied either from either above and below the cast piece, or from both above and below the cast piece.

Remarkably good effects are obtained when using continuous bloom casting on high carbon steel but the allowable technical range of this invention is not limited to this process or this steel.

The intervals for performing reduction in the above defined reduction gradients is determined in response to variations in the (center) solid fraction in the cast piece center during the final solidification period. The center solid fraction used here was found in accordance with the following references, with non-steady state heat transfer solidification analysis by computer simulation based on the finite-element method or the finite differential method and by also taking into account the relation between solid fraction and temperature by means of micro-segregation analysis:

Tetsu to Hagane No. 78 (1992) No. 2 pp. 275–281.

In this invention, reduction starts from the 0.2 center solid fraction found as described above (or to rephrase, a position showing a value of 0.2 for the solid fraction for the cast piece center) or, if necessary a position upstream of this {cast mold side}. The center solid fraction on the other hand, gradually increases at the downstream side of the cast piece draw-out process but during this interval, reduction continues such that an optimal matching reduction gradient is chosen to diminish in stages/the step-like increase in the center solid fraction. The said reduction continues until the center solid fraction reaches 0.90 or if necessary, until the center solid fraction reaches 1.0.

When starting reduction in the interval up to where the center solid fraction is 0.2, the reduction gradient is set to comply with conditions in the previously mentioned (A) formula. When continuing reduction in the interval from where the center solid fraction is 0.90, the reduction gradient is set to comply with conditions in the previously mentioned (C) formula.

If reduction is not started even when the center solid fraction reaches 0.2 (or a more severe 0.20) but instead commenced after the solid fraction exceeded 0.2 then it signifies a delay in the reduction effect. Since solidification shrinkage has already started after exceeding the 0.2 point causing molten metal flow, there is an increased risk of segregation occurring. Delaying the start of reduction up to a center solid fraction position of 0.25 may be allowable according to the type of steel used. On the other hand when reduction is halted prior to a center solid fraction position of 0.90, forming of segregated portions may be unavoidable, since the solidification shrinkage makes molten steel flow likely to occur as reduction has been stopped. Also center porosity formations often occur since no countermeasures are taken to deal with the solidification shrinkage.

As explained previously, during reduction, the cast piece temperature gradually lowers and the center solid fraction gradually increases. At which point, the effect of the invention changes the extent of the reduction to lower it, in response to the increase in the center solid fraction. The reduction gradient is utilized as described below to indicate the extent of the reduction per the following concepts.

The reduction gradient provides a numeric figure in units of % per meter indicating what percent of reduction amount to perform per the cast piece draw-out length direction (units: m) with respect to the thickness direction of the cast piece.

Generation of V segregations are caused by absorption of solute enriched molten steel to the center section due to volumetric contraction during solidification of the molten metal in the final solidifying process of the cast piece. In order to therefore completely stop the flow of molten steel, it is necessary to reduce the volume of unsolidified steel in the cast piece by an amount just matching the volumetric contraction that occurs during solidification. This reduction is achieved by reduction of the solid cast piece. The amount of volumetric contraction during solidification however keeps pace with the solidification, in other words it decreases as the center solid fraction increases. This fact helped the creators of this invention to determine that the correct reduction gradient should decrease along with the increase in the center solid fraction. This feature makes this the first invention able to define an ideal reduction gradient.

In other words this invention is based on the concept of a reduction gradient that decreases according to the increase in the center solid fraction. To establish specific indicators to meet present objectives, various evaluations were performed.

Those results yielded the ideal reduction gradients shown in (A) through (C), according to the zones (1) through (3) mentioned above. The reasons for establishing these particular ranges are given below.

In zone (1) having a center solid fraction ≧0.2 and ≦0.45. In this zone solidification progress has been insufficient in the center part of cast piece and the molten flow in the cast piece interior shows a high fluidity. Therefore under these kind of circumstances the reduction gradient is inadequate and more specifically when less than 0.70 (%/m), residual V segregation is present due to insufficient reduction. However when the reduction gradient exceeds 0.90 (%/m), a large reduction is applied to the proximity of the solidification boundary and internal cracks occur prior to generation of inverse V segregation. When a reduction is applied prior to the center solid fraction position of 0.2, the functional effect is small but after starting reduction at a position from 0.2 onwards, the above problems are prone to occur due to the delayed reduction start so from the point of view of a reliable effect from this invention and stable operation, starting reduction from a prior point in close proximity to a center solid fraction of 0.2 is advisable. Therefore, in this invention performing reduction prior to a center solid fraction of 0.2 should not be omitted.

In zone (2) having a center solid fraction ≧0.35 and ≦0.65 to 0.75. In zone (2) solidification has progressed further than in zone (1) and the solidified shell has become considerably large so that the volume of the unsolidified portion decreases and the amount of solidification shrinkage decreases correspondingly. The lower limit of the reduction gradient for which insufficient reduction cannot occur is therefore shifted to a lower value than that fixed for zone (1). This lower limit at which V segregation will not occur is 0.30 (%/m). The upper limit however is fixed to prevent inverse V segregation that occurs due to molten metal back flow, is set to 0.48 (%/m) which is lower than in zone (1).

In zone (3) having a center solid fraction ≧0.65 and ≦0.90. In this zone the solidification has progressed even further and the solidification shell has developed greatly. Accordingly, the reduction gradient lower limit where V segregation will not occur due to insufficient reduction, has been lowered to 0.08 (%/m). The upper limit however at which inverse V segregation will not occur due to molten metal back flow is lowered to 0.16 (%/m). Applying a reduction from a center solid fraction of 0.90 onwards will not have a significant effect on operation. However as related previously, omitting application of a continuous reduction up to 0.90 is not recommended.

Classifying the zones into (1) through (3) as above for a center solid fraction in the vicinity of (0.35 to 0.45) or (0.65 to 0.75) is a compromise for obtaining relatively high flexibility, in view of the fact that molten metal flow characteristics change according to the constituent composition of the metal. This invention provides a certain amount of flexibility in classifying the limits for zones shown as in the upper limit of the zone (1), the upper and lower limits of zone (2) and the lower limit shown in zone (3). However as further shown in zone (1–2) and in zone (2–3), a further wide range of flexibility is tolerated within the zone division itself. The reason being that this invention is intended to lower the reduction gradient in each zone according to the zone classification so that the optimal reduction gradient can be selected within the range shown in each of the said formulas of (A), (B), (C), (A–B) and (B–C) for each respective zone, provided other conditions are correct.

FIG. 1 shows the ranges in the invention as described above with the hatched solid lines in the drawing showing the specific area as claimed. The dashed lines in the drawing show an additional wider range of flexibility provided by this invention.

There are no particular limits on the reduction roll used with this invention. The previously related flat roll and stubby roll can be used. However the short-barrel roll developed by the applicant as related later, is preferable. Namely because the flat roll and the stubby roll have the problems described next.

The flat roll is made to reduce the entire surface including the shell showing high rigidity developing from both sides of the case piece towards the center so that reduction resistance is high (a particularly high resistance in the case of the small bloom cast piece with its small flatness ratio). The solidification shrinkage in the unsolidified cross sectional area in the center has adverse effects on efficiency (reduction efficiency) so that a large amount of reduction is needed to prevent segregation and load imposed on the roll is high, creating the problem of severe wear on the roll and shaft bearings. The equipment and operation costs to supply the required reduction pressure are also high. The stubby roll on the other hand, reduction with only the center portion which is larger than the edges of the roll, on the center of the cast piece, so that reduction resistance from the high rigidity of the above mentioned shell is slight. This means that the reduction efficiency is therefore improved and the effective prevention of segregation and center porosity with a comparatively small reduction pressure is obtained. However, to keep thermal deformation of the roll in low level by heat transfer from the cast piece and maintain precision of roll dimensions, both ends of the roll must be made considerably large. This means that the center section of the roll must also be enlarged and that the interval (pitch) between stub rolls adjoining in the cast direction must also be enlarged. Therefor, cast piece bulging (expansion of the cast piece occurring between the rolls) becomes bigger with the problem that the ability to prevent segregation and porosity is lost.

At which point the applicant for this invention developed a reduction roll (referred to as a short-barrel roll in this invention) having an effective length 0.2 to 0.8 times that of the cast piece width. Patent application for this roll has already been made (Japanese Patent Laid-open No. 6-210420).

FIG. 3 is a descriptive drawing showing the concept of the short-barrel roll of this invention. In FIG. 3, the numeral 1 denotes the short-barrel roll, the numeral 2 denotes the cast piece, the numeral 4 is the shaft, and the numeral 5 is the flat roll. In FIG. 4 the short-barrel roll is applied from the upper side of the cast piece, the lower side shows the case when supported by the flat roll 5 however short-barrel rolls of identical dimensions can be applied from both above and below. This short-barrel roll was previously described in Tokkai-hei 6-210420 but essentially the barrel length W of short-barrel roll 1 is effectively shorter than width dimension W' of cast piece 2. The short-barrel roll should in particular be utilized so as to satisfy the conditions below such that:

$$0.2W' \leqq W \leqq 0.8W \quad (P)$$

and more preferably $$0.3W' \leqq W \leqq 0.7W \quad (Q)$$

Since the barrel length of this kind of short-barrel roll is small, it will still have sufficient strength without having to increase the radius. This means the roll diameter can be decreased if needed and the roll pitch dimension reduced to inhibit the bulging defect in conventional technology that is prevalent in stubby rolls. A roll pitch within 350 mm is recommended for preventing bulging.

As is clearly evident from FIG. 3, the short-barrel roll of this invention can be applied for solute enriched, highly efficient reduction of unsolidified section 3 of the cast piece center section, so that the necessary amount of reduction for segregation and center porosity can be held to a minimum and operation costs reduced. Another benefit is that since the roll surface and roll shaft friction is decreased, maintenance expenses for the equipment can be lowered. This kind of roll can be utilized in all of the above mentioned reduction zones (1) through (3) but as shown in FIG. 3, since reduction from the short-barrel roll is particularly effective in cast pieces whose unsolidified sections have become smaller, the short-barrel roll can be used only for zones from (2) to (3), and the conventional flat roll or short-barrel roll can be used for zone (1).

When the above (P) formula is not satisfied, for example when W is smaller than 0.2 W' reduction cannot be done over the entire width of unsolidified section 3 so that prevention of segregation is insufficient. On the other hand, when W is larger than 0.8 W', a large resistance is caused by the solid shell so that it is difficult for the reduction to prevent segregation by small reduction. As related previously, the short barrel roll of this invention can be set for reduction from both the top and bottom of cast piece 2, or from either the top or the bottom, and preferably the previously mentioned flat roll used to perform reduction from the opposite side. Thus it is not necessary that an identical arrangement be used for all reduction over the entire length of the reduction zone, and alternate use of the above arrangements are also possible.

This invention is suitable for a wide range of cast pieces from low carbon to high carbon steel regardless of their cross sectional shapes or dimensions. In any case, it is evident that the desired effect will be obtained and that a great improvement will be obtained in particular for bloom continuous casting using high carbon steel.

This invention having the structure described above, enables the manufacture of cast pieces with no center segregation center porosity, or internal cracks due to a process for controlling the reduction based on a satisfactory relation in the unsolidified stage, between the center solid fraction and the reduction gradient, so that optimal reduction conditions are employed to ensure excessive or insufficient reduction, roll abrasion and shaft abrasion do not occur. In particular, in conventional bloom continuous casting where cooling in the cast piece draw-out process proceeds slowly and the equiaxed crystal is widely formed, remarkably evident V segregation occurrs due to permeation of the solute enriched molten flow through equiaxed crystals by solidification shrinkage in the axial center portion at final solidification. However it was confirmed that the present invention shows excellent results in preventing these kinds of segregation problems. In addition, center segregation is stably cleared up without bulging problems.

BRIEF DESCRIPTION OF THE DRAWINGS

The aforesaid and other objects and features of the present invention will become more apparent from the following description and the accompanying drawings.

DESCRIPTION OF THE PREFERRED EMBODIMENTS

Figure 1:
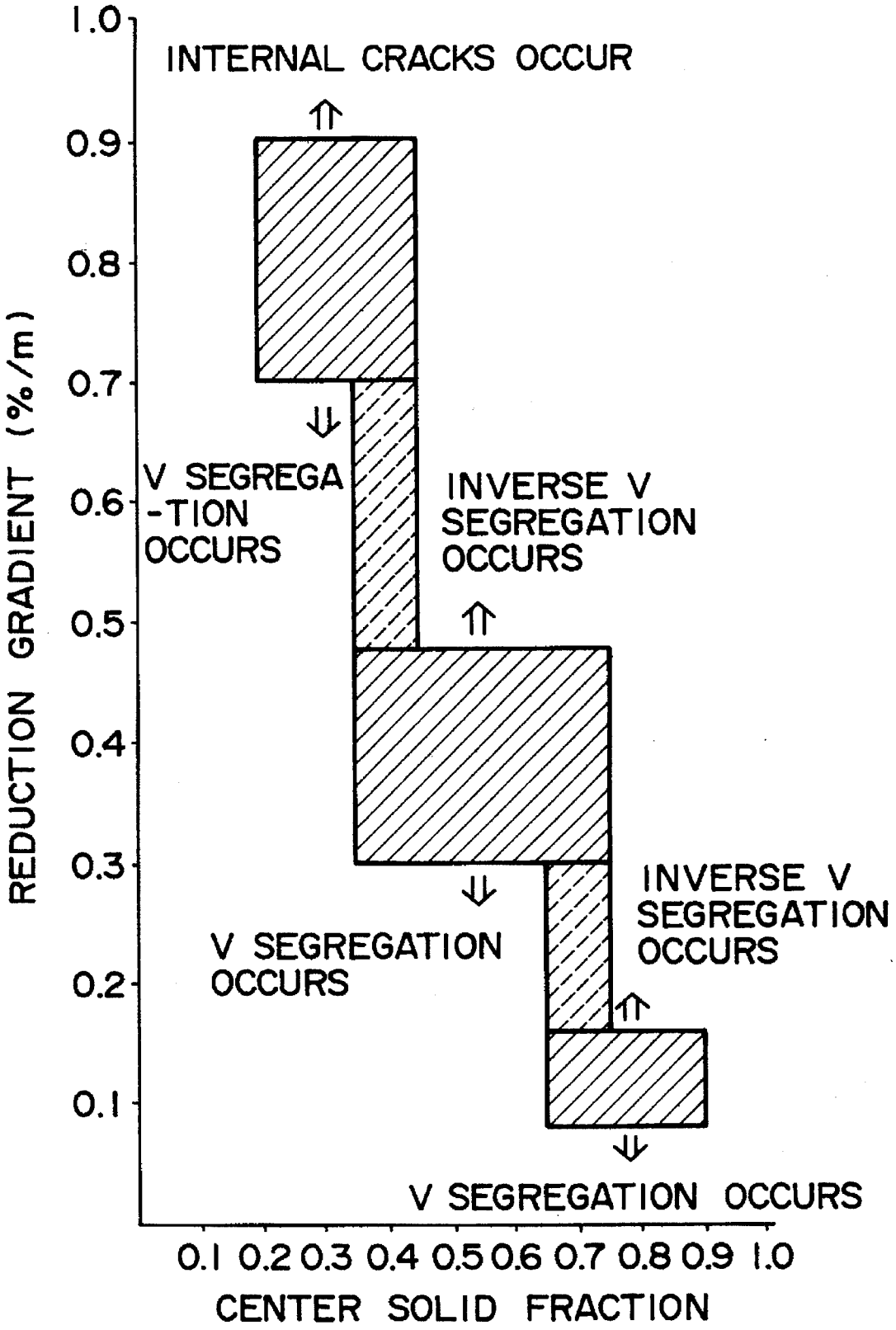
FIG. 1 is a graph showing favorable condition range for this invention.
Figure 4:
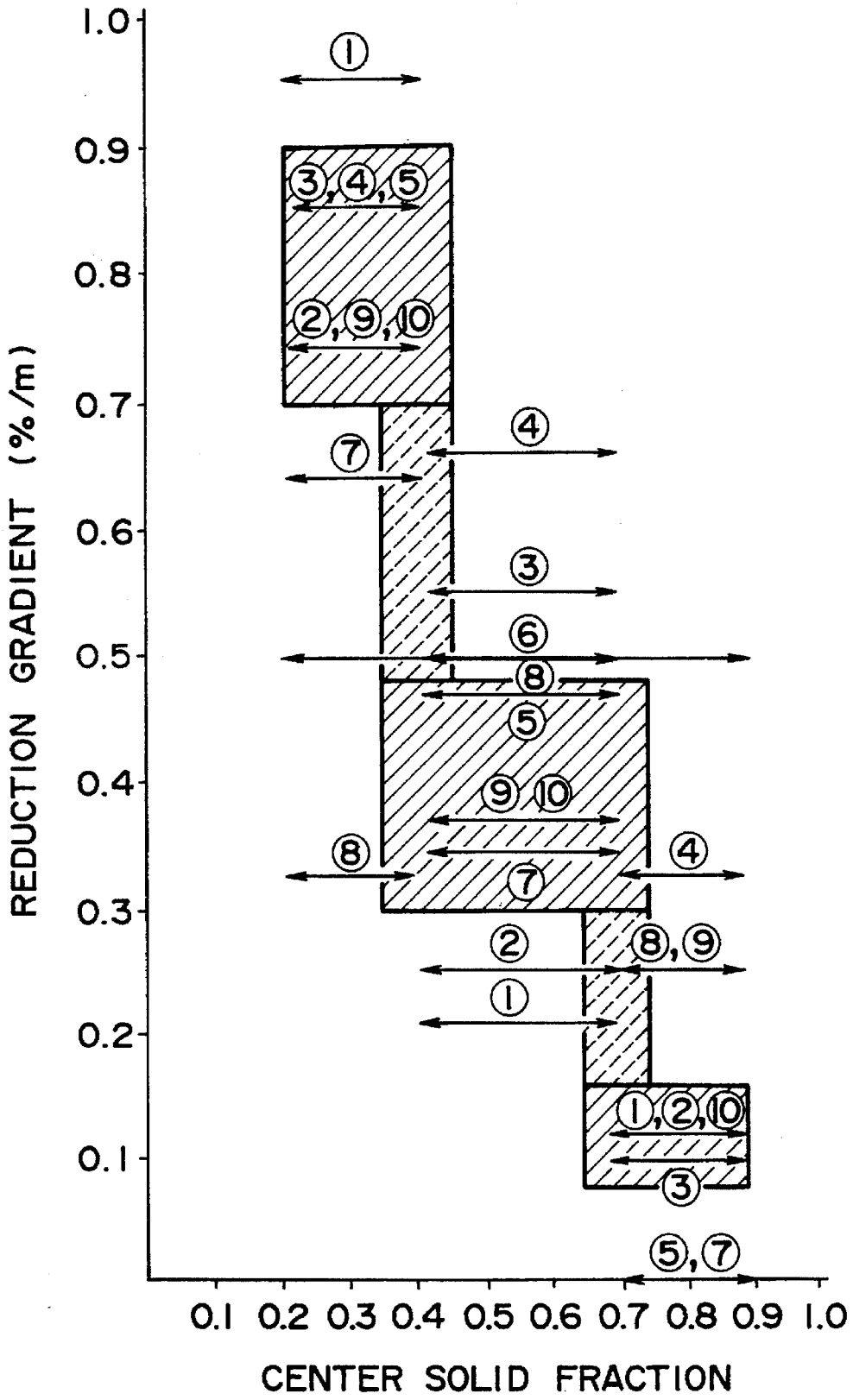
FIG. 4 is figure showing reduction pattern of the embodiment of this invention.

Bloom continuous casting (with in-mold electromagnetic stirring) was performed on a cast piece having a cross section size of 380 mm×600 mm and utilizing two kinds of steels, the carbon contents of which are 0.71 to 0.83% (refer to Table 1). Flat rolls were used on both top and bottom in zone (1), and in zones (2) and (3) short-barrel rolls were used on the top side and flat rolls were used for reduction on the bottom side. The roll pitch (roll pitch in the cast piece draw-out direction) between adjacent rolls was 320 mm.

lines in FIG. 4 show the range that satisfies the conditions of this invention just the same as in FIG. 1, with the circled numerals in FIG. 4 indicating the test No.s shown in Table 2. FIG. 4 therefore reveals whether or not conditions of this invention are satisfied in each test for reduction zones (1) through (3). The center segregation ratio in Table 2 is a ratio of the maximum analysis value (C) to the carbon content (Co) in the molten metal in 30 samples taken consecutively at a 10 mm pitch with a 5 mm diameter drill along the center line of longitudinal cross section, towards the casting direction.

In test 1, the reduction gradient in reduction zone (1) was large and and internal cracks occurred. In zone (2) inverse V segregation occurred since the reduction gradient was small. In test 2, a suitable reduction gradient was used for zone (1) so the internal crack situation is improved but since the reduction gradient in zone (2) is small the V segregation is not improved and remains. In test 3, since the reduction gradient in zone (2) is large and in test 4, since the reduction gradients for zones (2) and (3) are large, inverse V segregation appears for either case and the center segregation is not improved. In test 5, the reduction of zone (3) is omitted

TABLE 1

| | Chemical Compositions of Steels (mass %) | | | | | | |
|---|---|---|---|---|---|---|---|
| | C | Si | Mn | P | S | Cr | Al |
| Steel Type A | 0.71–0.73 | 0.18–0.25 | 0.45–0.55 | less than 0.010 | less than 0.005 | less than 0.03 | less than 0.003 |
| Steel Type B | 0.81–0.83 | 0.18–0.25 | 0.45–0.55 | less than 0.010 | less than 0.005 | less than 0.03 | less than 0.003 |

TABLE 2

| | Reduction, Gradient (%/m) | | | Results | |
|---|---|---|---|---|---|
| Test No. | Reduction Zone (1) | Reduction Zone (2) | Reduction Zone (3) | Center Segregation & Internal Cracks Status | Center Segregation Ratio C/Co |
| 1 | 0.95 (⇧) | 0.21 (⇩) | 0.12 (○) | Internal cracks, V segregation | 1.10 |
| 2 | 0.74 (○) | 0.25 (⇩) | 0.12 (○) | V segregation | 1.05 |
| 3 | 0.85 (○) | 0.55 (⇧) | 0.10 (○) | Inverse V segregation | 1.10 |
| 4 | 0.85 (○) | 0.66 (⇧) | 0.33 (⇧) | Inverse V segregation | 1.15 |
| 5 | 0.85 (○) | 0.47 (○) | 0 (⇩) | V segregation | 1.17 |
| 6 | 0.49 (⇩) | 0.49 (○) | 0.49 (⇧) | V segregation + Inverse V segregation | 1.22 |
| 7 | 0.64 (⇩) | 0.35 (○) | 0 (⇩) | V segregation | 1.20 |
| 8 | 0.33 (⇩) | 0.49 (⇧) | 0.25 (⇧) | V segregation | 1.17 |
| 9 | 0.74 (○) | 0.37 (○) | 0.25 (⇧) | Inverse V segregation | 1.14 |
| 10 | 0.74 (○) | 0.37 (○) | 0.12 (○) | No segregation | 1.02 |

○: Reduction gradient satisfies the range of this invention

⇧: Reduction gradient is larger than the range of this invention

⇩: Reduction gradient is smaller than the range of this invention

Table 2 shows the test conditions and the center segregation and internal cracks status of the cast piece center (visual determination at cast piece macroscopic level) as well as the center segregation ratio (maximum value). FIG. 4 also clearly shows the reduction zone and reduction gradient for each condition. The solid lines and the dashed so that near the cast piece center which has a high center solid fraction, the solute enriched molten flow occurs, and as a result V segregation was detected and the center segregation ratio is also unsatisfactory. In any of tests 6, 7, and 8, since the reduction in zone (1) was weak large V segregation was found and almost no significant effect from reduction was observed. In reduction zone (3) of test 6, the reduction gradient was too large so that there was a shift of solute enriched metal flow near the center of the cast piece and inverse V segregation was found. In test 7, a remarkable layer of V segregation appeared, also due to omission of reduction in reduction zone (3). In test 8, the reduction in reduction zones (2) and (3) were excessively but since the reduction in reduction zone (1) was extremely weak, V segregation remains.

In test 9, inverse V segregation occurred in the related section due to the large reduction gradient in reduction zone (3). However in test 10 which satisfied the range of this invention, neither V segregation nor inverse V segregation occurred and the center segregation ratio was near a value of 1.0.

Figure 2:
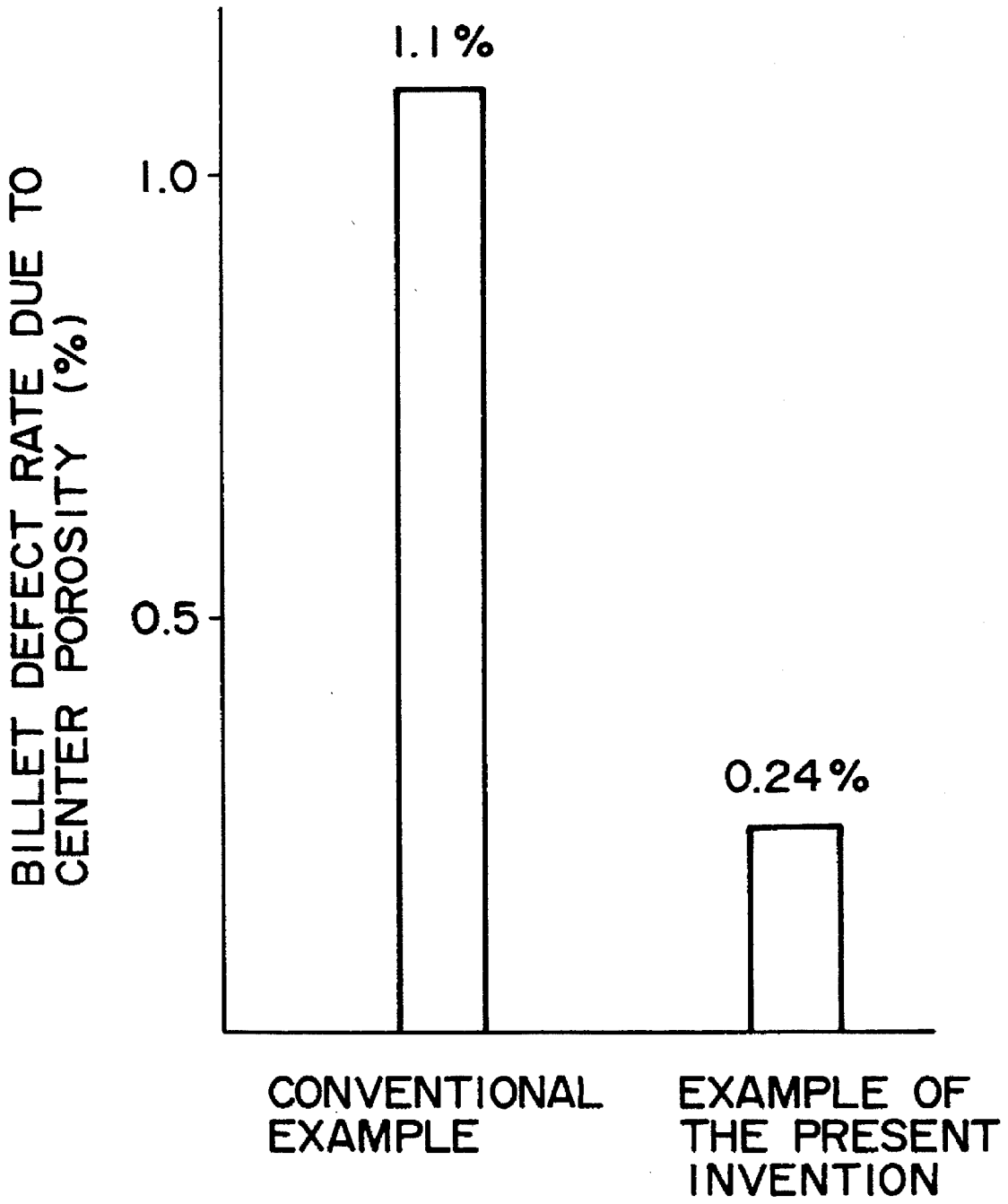
FIG. 2 is a graph comparing the method of this invention and the conventional method by showing the billet defect rate due to center porosity.
Figure 3:
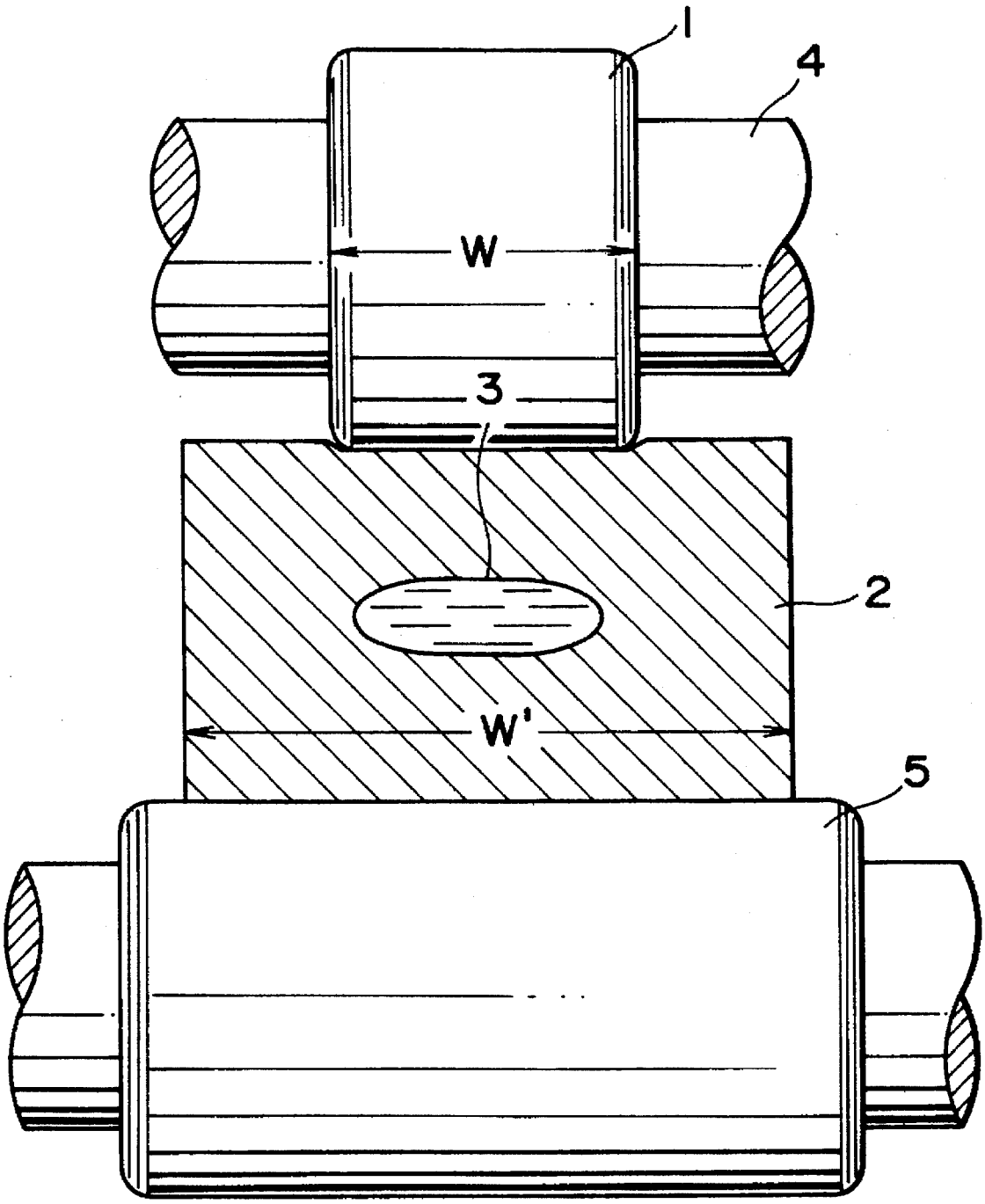
FIG. 3 is a conceptual drawing illustrating the short-barrel roll of this invention.

FIG. 2 shows the effect of this invention on the billet defect rate due to center porosity in low carbon steel (carbon content below 0.18%) rolled from the said bloom. The reduction conditions here were the same as those in the embodiment of test 10.

What is claimed is:

1. A continuous casting method comprising the steps of:

drawing out a cast piece as a continuous casting having a center solid fraction which increases with the length of the casting in meters as the casting cools; and reducing the thickness of the casting by a reduction gradient during the drawing out step, the reduction gradient decreasing according to an increase in the center solid fraction and comprising a percent of cast piece thickness per casting length in meters and having a value satisfying:

A) reduction gradient=0.70–0.90%/meter in a first zone where the center solid fraction≧0.2 and ≦0.45, B) reduction gradient=0.30–0.48%/meter in a second zone where the center solid fraction≧0.35 and ≦0.75, and C) Reduction gradient=0.08–0.16%/meter in a third zone where the center solid fraction≧0.65 and ≦0.90.

2. The method of claim 1 wherein, where the center solid fraction is 0.35–0.45, the reduction gradient is 0.30–0.90 and is equal to or smaller than the reduction gradient selected in the first zone and equal to or larger than the reduction gradient selected in the second zone, and where the center solid fraction is 0.65–0.75, the reduction gradient is 0.08–0.48 and is equal to or smaller than the reduction gradient selected in the second zone and equal to or larger than the reduction gradient selected in the third zone.

3. A continuous casting method of claim 1 in which the reduction roll for applying reduction after the center solid fraction of the cast piece has reached 0.35 to 0.45, is arranged to apply reduction on at least one side of the cast piece so that the roll barrel is 0.2 to 0.8 times larger than the cast piece width.

4. A continuous casting method of claim 2 in which the reduction roll for applying reduction after the center solid fraction of the cast piece has reached 0.35 to 0.45, is arranged to apply reduction on at least one side of the cast piece so that the roll barrel is 0.2 to 0.8 times larger than the cast piece width.

* * * * *